US006036268A

United States Patent [19]

Larson

[11] Patent Number: 6,036,268

[45] **Date of Patent: *Mar. 14, 2000**

[54] FOOT REST MECHANISM FOR A WORK CHAIR

[76] Inventor: John E. Larson, P.O. Box 1197, Hamilton, Mont. 59840

[ * ] Notice: This patent issued on a continued prosecution application filed under 37 CFR 1.53(d), and is subject to the twenty year patent term provisions of 35 U.S.C. 154(a)(2).

[21] Appl. No.: 08/925,089

[22] Filed: Sep. 8, 1997

[51] Int. Cl.[7] ..... A47C 1/034; A47C 7/50

[52] U.S. Cl. ..... 297/423.26; 297/423.2; 297/423.28

[58] Field of Search ..... 297/423.25, 423.2, 297/423.26, 423.28, 423.38

[56] References Cited

U.S. PATENT DOCUMENTS

| | | | |
|---|---|---|---|
| 1,590,240 | 6/1926 | Gorton . | |
| 2,044,992 | 6/1936 | May | 297/423.25 |
| 2,308,358 | 1/1943 | Cramer . | |
| 3,414,321 | 12/1968 | Beck . | |
| 4,046,419 | 9/1977 | Schmitt . | |
| 4,148,524 | 4/1979 | Guyton . | |
| 4,369,997 | 1/1983 | Desanta | 297/68 |
| 4,408,801 | 10/1983 | Edel et al. . | |
| 4,410,215 | 10/1983 | McKean et al. . | |
| 4,451,082 | 5/1984 | Giordani . | |
| 4,470,634 | 9/1984 | Delius et al. | 297/423.26 |
| 4,508,387 | 4/1985 | Gilbert et al. | 297/423.38 |
| 4,509,795 | 4/1985 | Brennan et al. . | |
| 4,635,999 | 1/1987 | Simpson . | |
| 4,819,987 | 4/1989 | Stringer . | |
| 5,011,227 | 4/1991 | van Hekken et al. . | |
| 5,039,167 | 8/1991 | Sweet | 297/423.28 |
| 5,344,217 | 9/1994 | McLaughlin | 297/423.25 |
| 5,447,359 | 9/1995 | Asbjornsen et al. | 297/423.35 |
| 5,507,562 | 4/1996 | Wieland | 297/423.26 |
| 5,795,017 | 8/1998 | Zimmerman et al. | 297/423.28 |

*Primary Examiner*—Anthony D. Barfield
*Attorney, Agent, or Firm*—Jerry Johnson

[57] ABSTRACT

The foot rest mechanism of the present invention comprises chair attachment means for attachment to the underside of a work chair seat, a foot rest actuating mechanism supported by the chair attachment means for guided forward and rearward movement in relation to the chair attachment means, a foot rest including a foot rest platform and at least two foot rest platform support arms each having a first and second end. The first end of the support arms is attached to the foot rest platform and the second ends of the support arms are attached to the foot rest actuating mechanism. The support arms moveably suspend the foot rest platform in relation to the chair seat. Pivot means pivotally connect the second ends of at least two foot rest platform support arms to the chair attachment means. Forward or rearward movement of the foot rest actuating mechanism forces the second ends of at least two support arms to pivot about the pivot means wherein small forward or rearward movements of the foot rest actuating mechanism correspond to large forward or rearward movements at the foot rest platform. The foot rest mechanism additionally typically comprises means to lock the foot rest actuating mechanism in a fixed forward or rearward position in relation to the chair attachment means. The foot rest mechanism additionally may comprise means to adjust the vertical position of the foot rest platform on the foot rest platform support arms. The foot rest actuating mechanism may include moving arm rests or hand grips, or a gas spring mechanism.

36 Claims, 8 Drawing Sheets

FOOT REST MECHANISM FOR A WORK CHAIR

BACKGROUND

Work chairs often position workers in a posture where the worker slouches in his or her chair. The slouched posture causes the spine of the worker to be in a rounded condition known as kyphosis. A sitting posture that causes kyphosis of the spine is damaging to the back because the spinal column is displaced from its normal curvature. When the seated person maintains the normal curvature of the back, known as lordosis, little or no strain is place on the discs of the spinal column or on the soft tissue adjacent to the spine. When the seated person slouches forward causing the back to be rounded, the discs are stressed at their forward edges. Additionally, the muscles and the other soft tissue adjacent to the spinal column must stretch excessively to accommodate the rounding of the back.

Office work using a computer, microscope, or drafting table often requires a static posture for long periods of time. Workers maintaining a poor sitting posture for long periods often may cause static stress injuries to the discs of the spinal column or to the adjacent soft tissue. For workers with back injuries, a poor seated posture causing kyphosis of the spinal column can inflame the previously damaged tissue resulting in considerable discomfort.

As the understanding of work related injuries has increased, attempts have been made to improve the postures of seated workers. The typical solution suggested to workers to improve their posture is to use an independent, floor supported foot rest to raise their feet above the floor. Once the feet are raised, the user can more easily sit upright in a sitting posture that restores lordosis to the spine.

While these foot rests are somewhat successful in improving the posture of the worker seated at a work chair there are deficiencies with the use of foot rests of this type. A first deficiency results from the foot rest existing independent of the chair. This feature results in the foot rest often being located away from where it is convenient to reach and consequently the foot rest is unused. Several foot rests of this type would be needed to correspond to the various work locations within a modern office where a worker may be required to work during a normal work day.

Another problem with foot rests of this type is due to the inability to adjust the height of the foot rest to accommodate different chair seat heights. Modern work chairs allow the user to adjust the chair seat height to various vertical positions which help the user maintain a comfortable posture during various work tasks. A foot rest that is not able to be adjusted a corresponding amount does not allow the user to maintain the proper posture required at each chair height.

Elevated work chairs or stools have included foot rests integrally into the chair design. The foot rests used in these chairs have also had deficiencies. Foot rests for these elevated work chairs are commonly placed beneath the chair seat. In this position the legs are not forward enough for the user to easily maintain a proper posture with lordosis achieved in the spinal column. If foot rests of this type were more forward they would restrict chair maneuverability by obstructing the leg and foot area between the chair cushion and the floor.

Another problem with the foot rest mechanisms used in existing elevated chairs is the difficulty in positioning the foot rest into the desired position. The foot rest mechanisms currently in use often allow the foot rest to assume either of two positions (an in use position, and a retracted position) or are fixed into a single position. Obviously, foot rest mechanisms have not kept pace with the high degree of adjustability advanced in the design of the other chair components.

Because of the deficiencies associated with existing foot rests there is a need for a foot rest mechanism for work chairs that attaches directly to a chair where the foot rest is readily accessible and efficiently removed as an obstacle to the user's contact with the floor. There is also a need that this foot rest mechanism extends to an outward position relative to the chair seat so that proper leg extension can be achieved for proper posture. There is a further need for a foot rest mechanism that may be positioned at a variety of positions relative to the chair seat and can be repositioned with a minimum of effort. There is also a need for a foot rest mechanism of this type which can be attached to existing work chair designs including elevated stools as well as non-elevated work chairs.

SUMMARY

The present invention satisfies the previously mentioned needs for a foot rest mechanism for work chairs.

The foot rest mechanism of the present invention comprises chair attachment means for attachment to the underside of a work chair seat, a foot rest actuating mechanism supported by the chair attachment means for guided forward and rearward movement in relation to the chair attachment means, a foot rest including a foot rest platform and at least two foot rest platform support arms each having a first and second end. The first end of the support arms is attached to the foot rest platform and the second ends of the support arms are attached to the foot rest actuating mechanism. The support arms moveably suspend the foot rest platform in relation to the chair seat. Pivot means pivotally connect the second ends of at least two foot rest platform support arms to the chair attachment means. Forward or rearward movement of the foot rest actuating mechanism forces the second ends of at least two support arms to pivot about the pivot means wherein small forward or rearward movements of the foot rest actuating mechanism correspond to large forward or rearward movements at the foot rest platform. The foot rest mechanism additionally typically comprises means to lock the foot rest actuating mechanism in a fixed forward or rearward position in relation to the chair attachment means. The foot rest mechanism additionally may comprise means to adjust the vertical position of the foot rest platform on the foot rest platform support arms.

The foot rest mechanism may typically comprise four foot rest platform support arms wherein two support arms are attached to each end of the foot rest platform. In this configuration the support arms are attached to the foot rest actuating mechanism, and the two support arms, the foot rest platform, and the foot rest actuating mechanism comprise a pivoting parallelogram structure which supports the foot rest platform at each end of the foot rest platform for forward and rearward movement in relation to the work chair seat. Also in this configuration, the pivot means is disposed on at least two foot rest platform support arms beneath the attachment point of the support arm on the foot rest actuating mechanism, whereby forward movements of the foot rest actuating mechanism cause the support arm to pivot about the pivot means resulting in a rearward movement of the foot rest platform.

The chair attachment means of the foot rest mechanism comprises first and second attachment plates, wherein each attachment plate includes a guide slot and wherein the guide slots further include detents. The foot rest actuating mechanism includes a slide plate disposed adjacent to each of the attachment plates of the chair attachment means, and the slide plates include a slide pin for forward and rearward slidable engagement within the chair attachment means guide slots for retention within the guide slot detents wherein the slide pin is temporarily prevented from forward or rearward movement within the guide slot.

The foot rest actuating mechanism may additionally comprise a foot rest actuating mechanism connecting member disposed between the first and second attachment means and wherein the foot rest actuating mechanism connecting member is connected to each slide plate through the guide slots of the chair attachment means. The foot rest actuating mechanism may also additionally comprise an arm rest mechanism or a hand grip mechanism attached to each slide plate; wherein small forward or rearward movements of the arm rest mechanisms correspond to large forward or rearward movements at the foot rest platform. In another version of the invention the foot rest mechanism includes a gas spring attached to at least one slide plate which actuates the foot rest mechanism. In yet another version of the invention the foot rest mechanism includes a locking cam lever which comprises the means to lock the foot rest actuating mechanism in a fixed position.

The foot rest mechanism of the present invention provides benefits previously unavailable to users of work chairs.

A first benefit provided by the foot rest mechanism of the present invention is the ability of the foot rest platform to be extended to a position well in front of the chair seat. This extended position allows the user to place the legs in a forward elevated position. This allows the user to easily sit in a proper upright posture that achieves lordosis of the spinal column and maximizes the support offered by the back cushion of the chair.

A second benefit of the foot rest mechanism is the positional adjustability that is offered to the chair user. The foot rest platform can be easily set in the desired horizontal position relative to the chair seat. The foot rest mechanism can also be easily repositioned, to accommodate changes in seating position. Such small changes to the seating position are considered to be helpful in avoiding static stress injuries to the body while working. The foot rest mechanism easily accommodates these movements while ensuring that proper posture is maintained. The foot rest platform may also be adjusted vertically in relation to the chair seat to accommodate users of all sizes.

Another benefit of the foot rest mechanism of the present invention is the ease in which the foot rest is actuated. The foot rest in a the first preferred version is either arm rest actuated or hand grip actuated, gas spring actuated in a second version, or foot actuated in a third or fourth version. The foot rest actuating mechanism of the first preferred version of the invention supports either arm rests or hand grips that allow the user to manually actuate or move the foot rest into a desired position. The arm rests or hand grips also allow the user to quickly retract the foot rest to a position under the chair seat to allow unobstructed contact with the floor.

The foot rest actuating mechanism, which supports either an arm rest or hand grip slides on a pin that can engage detents at spaced horizontal positions which temporarily locks the mechanism in place. As moving the arm rests or hand grips forward or rearward causes the foot rest platform to move correspondingly, this feature also temporarily locks the foot rest platform in place. In a preferred version the foot rest platform moves rearwardly or retracts as the arm rests move forward. This allows user to have the arm rests in a very accessible forward position when standing up or sitting down. Once seated the user can move the arm rests rearward which actuates or moves the foot rest forward into position. In a second version, the user moves a lever which actuates a gas spring which moves the foot rest into position. In a third and fourth version of the present invention where neither a gas spring or an arm rest or hand grip are used, the user can move the foot rest platform into position by first unlocking the foot rest locking lever and then moving the foot rest platform into position with the feet. In all three versions, the foot rest platform is easily actuated or moved into position for use.

Yet another benefit of the foot rest mechanism of the present invention is derived from the ability of the mechanism to be easily accommodated by existing work chair structures. The foot rest mechanism can be included as an original equipment manufacturing feature on new chairs with the mechanism easily attached to either the chair seat or to the tilt control mechanism of the chair which supports the chair seat. Alternatively, the foot rest mechanism could be retrofitted to existing chairs with little trouble. These and other advantages of the present invention will become apparent upon inspection of the accompanying specification, claims, and drawings.

DRAWINGS

FIG. 3 shows the arm rest mechanism as was shown in FIGS. 1 and 2, as well as a hand grip mechanism which is an alternative to the arm rest mechanism.

DESCRIPTION

Figure 1:
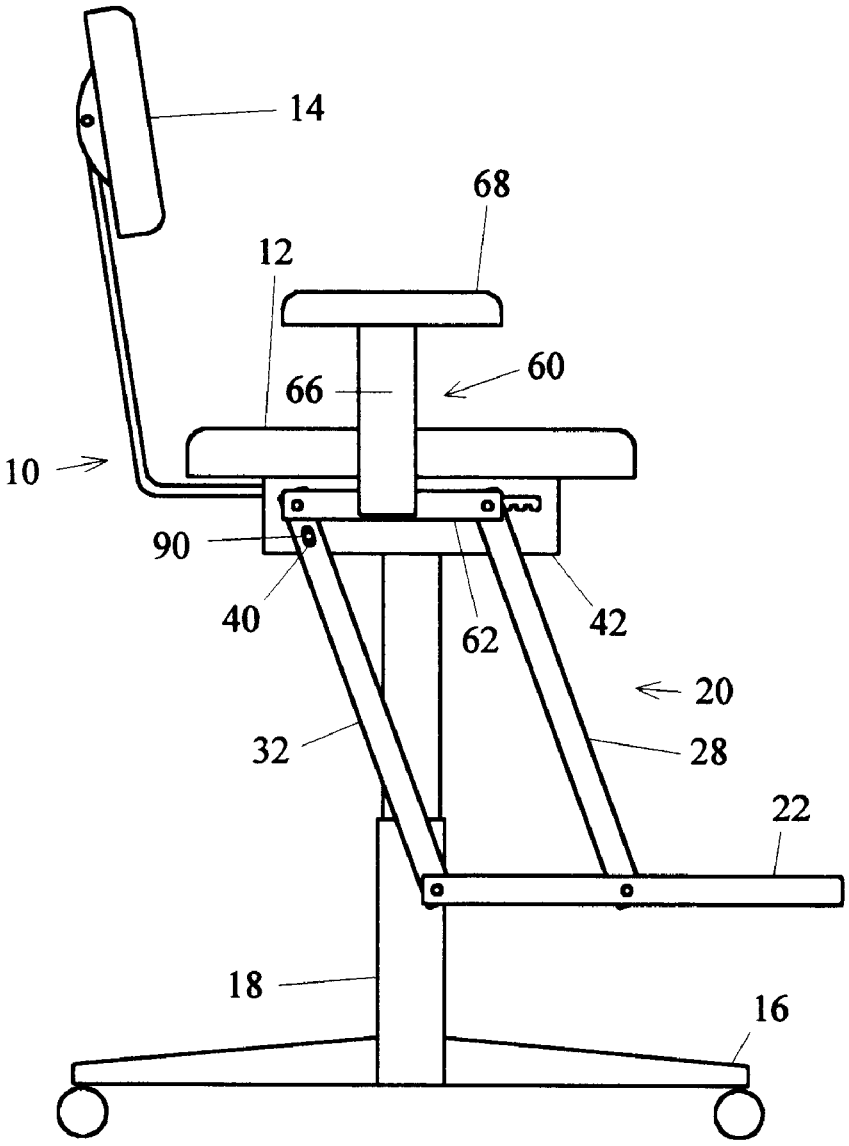
FIG. 1 shows a side view of a work chair including a first version or the foot rest mechanism of the present invention in an extended position.
Figure 2:
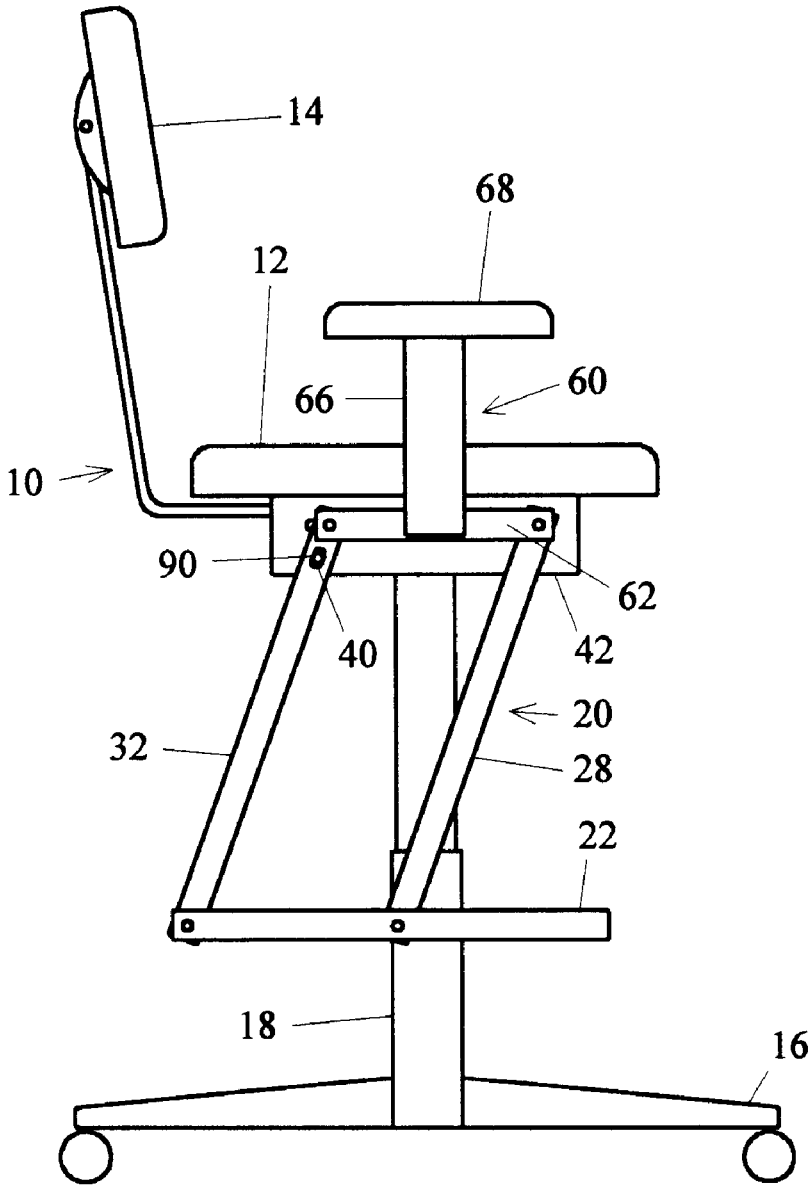
FIG. 2 shows a side view of a work chair including a first version or the foot rest mechanism of the present invention in an retracted position.
Figure 3:
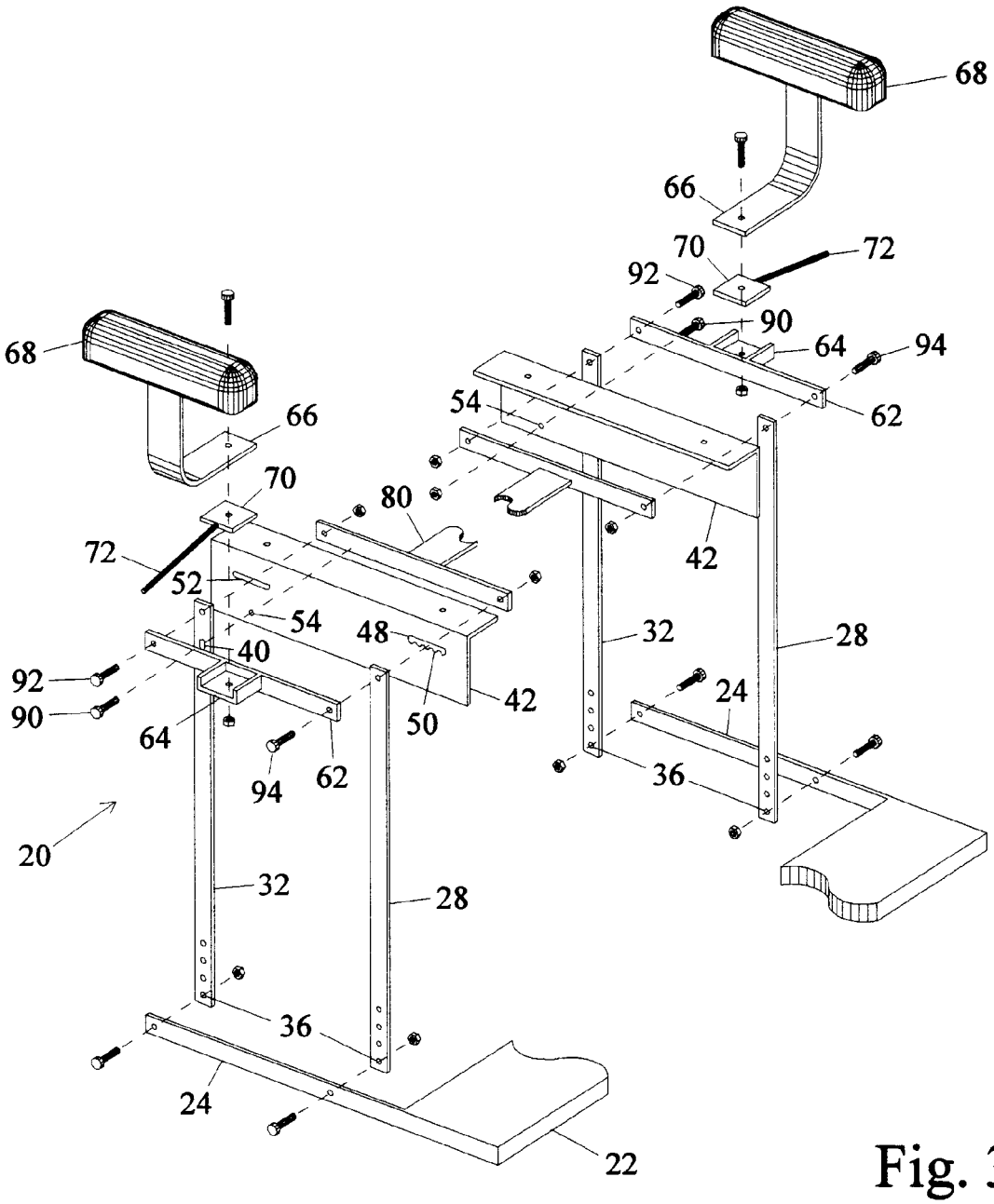
FIG. 3 is an exploded view of the first version of the foot rest mechanism shown in FIGS. 1 and 2.
Figure 4:
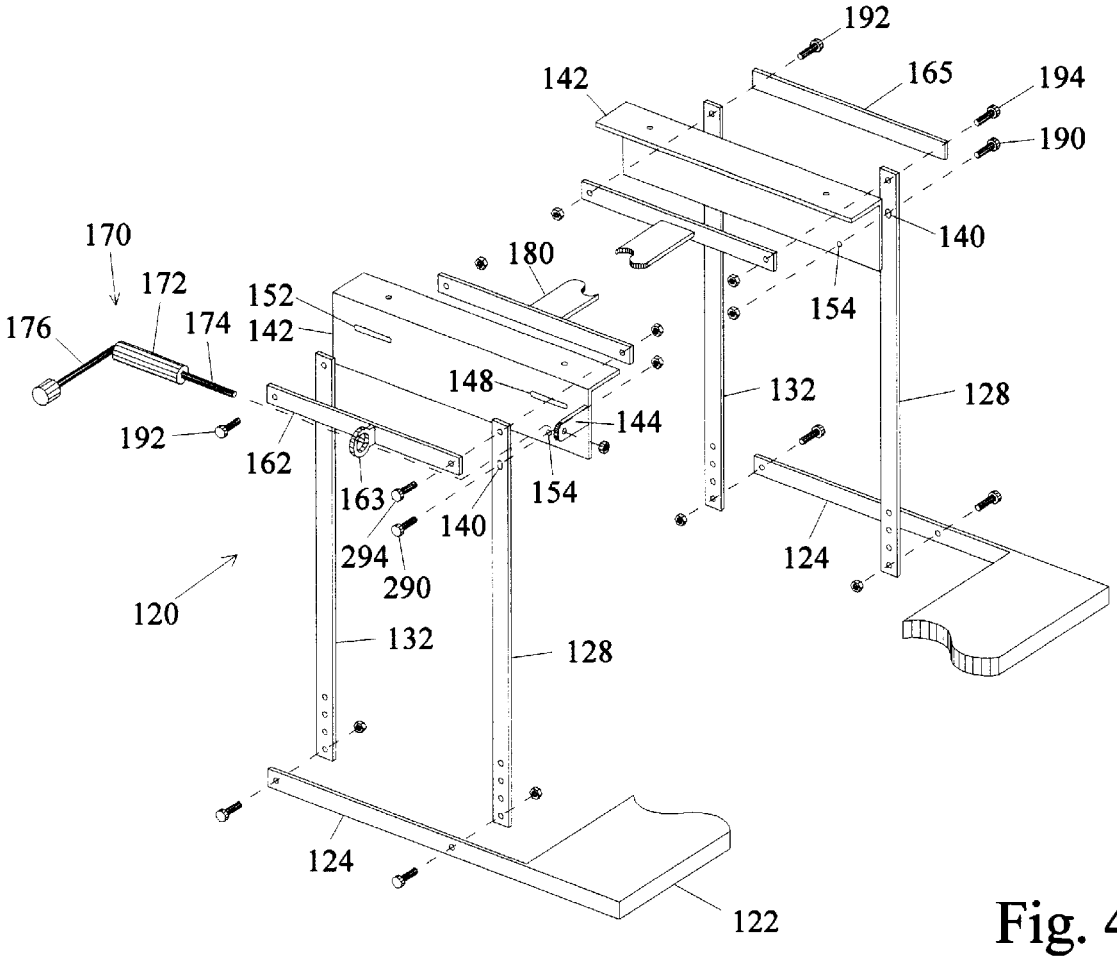
FIG. 4 is an exploded view of a second version of the foot rest mechanism which includes a gas spring.
Figure 5:
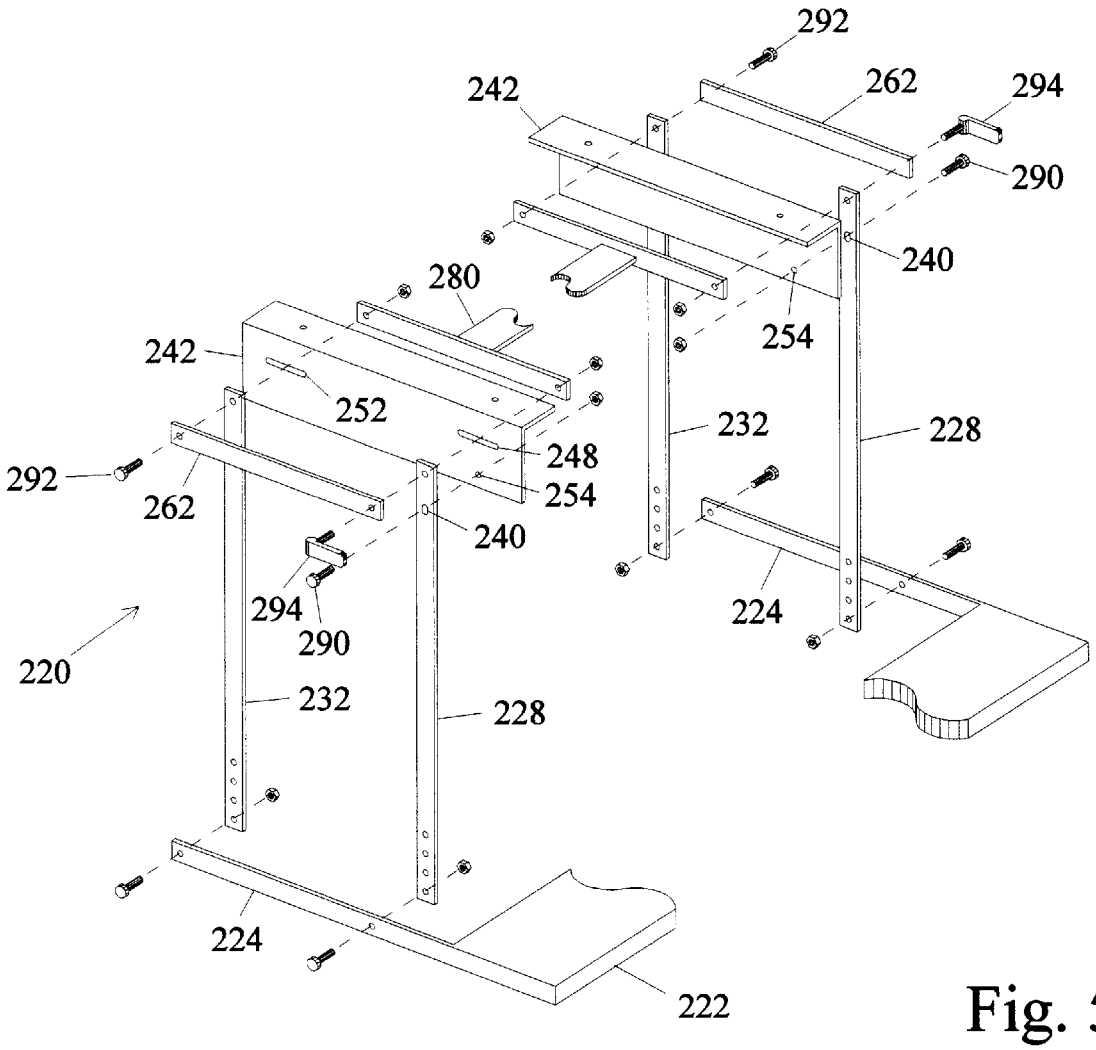
FIG. 5 is an exploded view of a third version of the foot rest mechanism which includes a cam locking lever.
Figure 6:
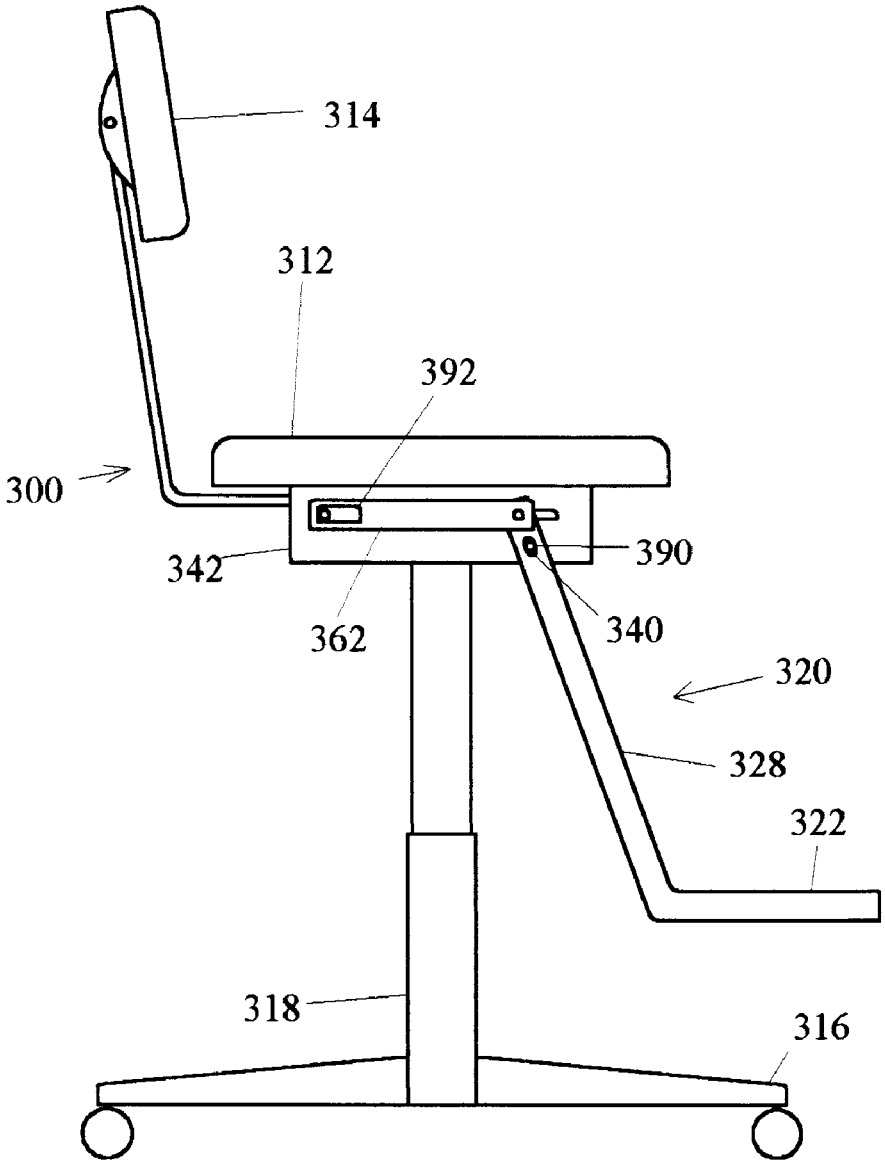
FIG. 6 is a side view of a work chair including a fourth version of the foot rest mechanism of the present invention shown in an extended position.
Figure 7:
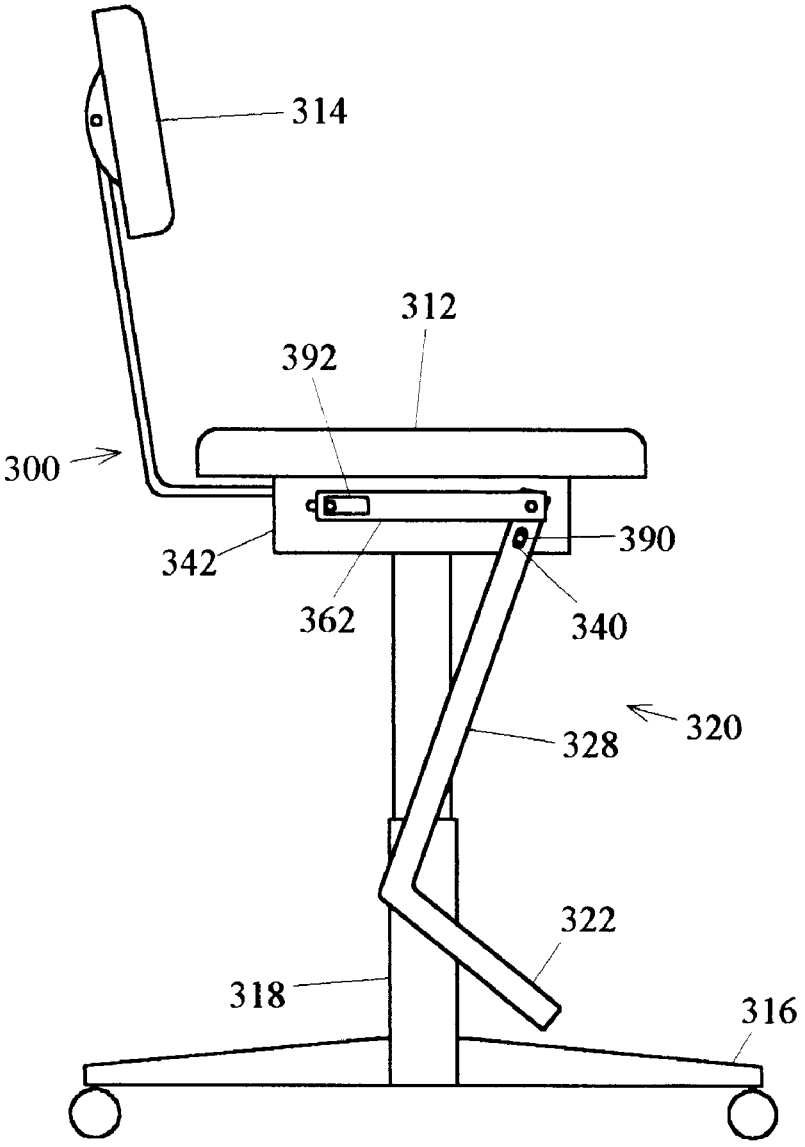
FIG. 7 is a side view of a work chair including a fourth version of the foot rest mechanism of the present invention shown in a retracted position.
Figure 8:
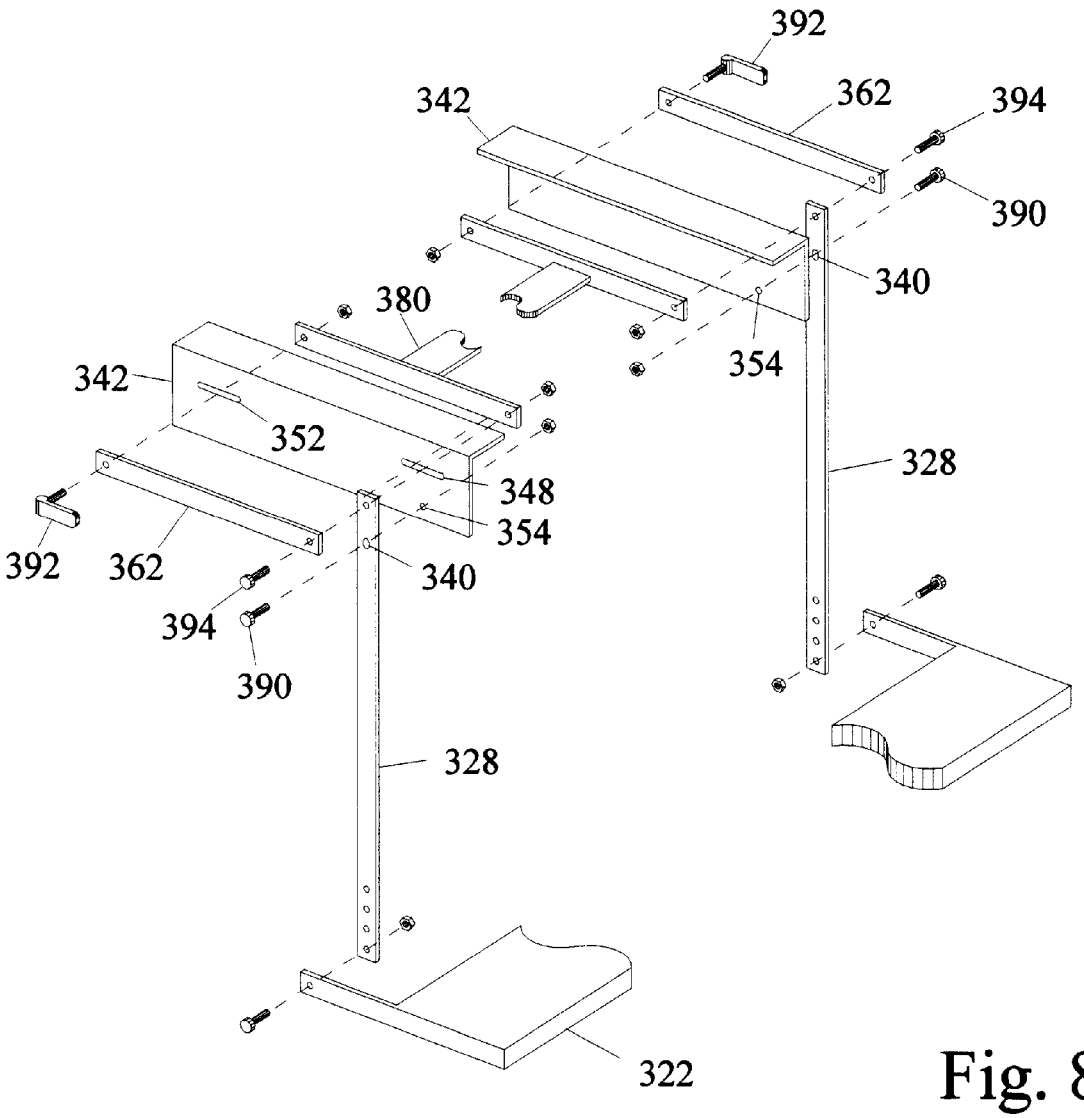
FIG. 8 is an exploded view of the foot rest mechanism shown in FIGS. 6 and 7.

Briefly in the drawings, FIG. 1 shows a side a side view of a work chair 10 including a first version of the foot rest mechanism 20 of the present invention in an extended position. FIG. 2 the foot rest mechanism 20 in a retracted position. FIG. 3 is an exploded view of the first version of foot rest mechanism 20 as was shown in FIGS. 1 and 2. FIG. 4 is an exploded view of a second version of the foot rest mechanism 120 which includes a gas spring mechanism 170. FIG. 5 is an exploded view of a third version of the foot rest mechanism 220 which includes a cam locking lever. FIGS. 6 and 7 are side views of a work chair 300 including a fourth version of the foot rest mechanism 320 of the present invention. FIG. 8 is an exploded view of the fourth version of the foot rest mechanism 320 of the present invention.

In greater detail, FIG. 1 shows a work chair 10 which comprises a seat 12, a back rest 14, a base 16 and a vertically adjustable pedestal 18 which supports the seat in an elevated position relative to the base 16. Attached to the work chair 10 is a foot rest mechanism 20. The foot rest mechanism comprises a foot rest platform 22, which is attached to the chair seat by a pivoting parallelogram structure which includes a first pair of parallel foot rest platform support arms 28 and 30.

The pivoting parallelogram structure is pivotally attached to a foot rest actuating mechanism 60 which in the version shown in this figure comprises an arm rest assembly comprising an arm rest support 66 and an arm rest 68 attached to a slide plate 62. The foot rest actuating mechanism slide plate 62 is supported for slidable movement by an attachment plate 42. Attachment plate 42 is secured to either the bottom of the chair seat or to the chair tilt control mechanism which is also attached to the bottom of the chair seat. Slide plate 62 provides an attachment for the arm rest support 66 and also supports the parallel foot rest platform support arms 28 and 30. Support arms 28 and 30 are pivotally attached to the slide plate as well as to the foot rest platform 22. Foot rest platform support arm 32 includes a slot 40 within which is disposed a pivot bolt 90 which pivotally attaches the support arm 32 to the attachment plate 42.

The arm rest 68 which is connected to the slide plate 62 through the arm rest support 66 moves horizontally with the slide plate in relation to the attachment plate 42. The horizontal movement of the slide plate 62 causes the upper ends of two foot rest platform support arms 28 and 32 to also move horizontally with the slide plate. Support arm 32, which is additionally pivotally attached to the attachment plate 42 through the pivot bolt 90 pivots about the bolt during horizontal movement of the slide plate 62. A forward horizontal movement of the arm rest 68 causes a rearward movement of the foot rest platform 22 due to the support arm 32 pivoting about the pivot bolt 90. In FIG. 1 the arms are shown moved to a rearward position which moves the foot rest platform 22 into an extended position forward of the chair seat 12.

FIG. 2 shows the foot rest platform retracted to a position under the chair seat 12. In this figure the arm rest 68 has been moved forward in relation to the chair seat 12. This forward movement of the arm rest moves the slide plated 62 forward which in turn moves the pivotally attached upper ends of the support arms 28 and 32 forward, as well. The forward movement of the upper ends of the support arms causes support arm 32 to pivot about the pivot bolt 90 which causes the lower ends of the support arms 28 and 32, as well as the foot rest platform 22 to move rearwardly and retract under the chair seat.

As is shown in FIG. 3, the foot rest mechanism 20 includes two sections that are mirror images of each other and are connected through a foot rest actuating mechanism connecting member 80, as well as through the foot rest platform 22. Only the first section of the foot rest mechanism was shown in the side views of FIGS. 1 and 2. Accordingly, the second section of the foot rest mechanism includes a second pivoting parallelogram structure comprising a second pair of parallel foot rest platform support arms 28 and 32 as well as a second slide plate 62 which is part of the foot rest actuating mechanism 60. The second pivoting parallelogram structure is supported by a second attachment plate 42.

As is shown in this figure, the two pivoting parallelogram structures of the foot rest mechanism 20 each support one end of the foot rest platform 22. The pivoting parallelograms comprise first and second foot rest platform support arms 28 and 32 which are pivotally attached at their lower ends to the foot rest platform extension 24 at pivot holes 36. The pivot holes 36 extend from the end of the support arms toward the center of the support arms and allow the platform 22 to be vertically adjusted on the support arms.

Referring to the first section of the foot rest mechanism only, the upper ends of the support arms 28 and 32 are pivotally attached to the slide plate 62 through pivoting slide pins 92 and 94. Slide plate 62 additionally includes a mounting channel 64 which can support either an arm rest support 66 or a hand grip support 70. The arm rest support 66 is attached to arm rest 68. The hand grip support 70 is attached to a hand grip 72. The slide plate 62 in addition to either an arm rest and arm rest support, or a hand grip and a hand grip support, comprise the foot rest actuating mechanism.

Attachment plate 42 includes a first section which form the attachment surface either to the underside of a chair seat or could be attached to the chair tilt control mechanism which typically attaches the chair seat to the supporting pedestal. Alternatively, the attachment plate could be integrally formed with the chair tilt control mechanism. Additionally, the attachment plate first section includes mounting holes which could allow fasteners to fasten directly to T-nuts disposed in the bottom of the chair seat.

Depending from the attachment plate first section and extending downwardly therefrom is a second section which forms the attachment surface for the foot rest actuating mechanism 60. As was previously stated, the foot rest actuating mechanism 60 refers generally to either an arm rest assembly comprising an arm rest 68 and arm rest support 66, or a hand grip assembly comprising a hand grip 72 and a hand grip support 70, which are attached to a slide plate.

The slide plate 62 of the foot rest actuating mechanism is slidably attached to attachment plate 42 by slide pins 92 and 94. Slide pins 92 and 94 extend through the slide plates and are disposed within attachment plate guide slots 48 and 52. The slide pins 92 and 94 after passing through the attachment plate 42 are attached to a foot rest actuating connecting mechanism 80. Guide slot 48 includes a plurality of indents 50 which hold the slide pin 94 in various horizontal positions within the guide slot 48 and thereby secure the foot rest platform in a temporarily fixed position. Slide pin 92 is allowed to freely move horizontally within the guide slot 52.

Slide pins 92 and 94 also form the pivoting attachment joints that attach the upper ends of support arms 28 and 32 to the slide plate 62 as well as form the attachment of slide plate 62 to the foot rest actuating connecting member 80. It is understood that separate fasteners could have been utilized for these respective pivoting joints and that the slide pins 92 and 94 additionally serve as the pivoting attachment joints for attaching the support arms and the connecting member 80 to the slide plates 62 for the purpose of minimizing structural elements.

The attachment plate second section additionally includes a pivot hole 54 where pivot bolts 90 attach to the attachment plate after passing through slot 40 of support arm 32. The pivot bolt causes forward movements of the foot rest actuating mechanism 60 to cause rearward movements of the foot rest platform. Should pivot hole 54 be located above the guide slot 52, forward movement of the foot rest actuating mechanism 60 would move the foot rest forward and rearward movement of the actuating mechanism would cause a rearward movement of the foot rest. Foot rest actuating connecting mechanism 80 includes opposing slide plates and an intermediate connecting plate. The foot rest actuating mechanism connection member structurally attaches the slide plate 62 of the first section of the foot rest mechanism to the slide plate 62 of the second section of the foot rest actuating mechanism.

As was previously stated, the foot rest mechanism 20 includes two sections that are mirror images of each other and are connected through the foot rest actuating connecting member 80 as well as through the foot rest platform 22. The second section functions identically to the first section. The foot rest actuating connecting member ensures that the foot rest actuating mechanism 60 functions as a unitary structure when the mechanism 60 moves horizontally in relation to the two attachment plates so that both pivoting parallelogram structures also function in unison. Guide slots 48 and 52 are obstructed from view on the second attachment plate 42 in this view.

The foot rest mechanism of the present invention is simple in use. The user of the work chair would typically sit onto the chair when the foot rest platform is retracted as is shown in FIG. 2. If the work chair is elevated it is possible that the foot rest platform could be used as a step even in this retracted position. Additionally the arm rest assemblies are in the forward position which places the assemblies at a position which assists in entering or exiting the chair. Once the user sits down, the arm rest assemblies or hand grip assemblies can be moved rearwardly into their normal position relative to the chair seat. The arm rest assemblies as well as the hand grip assemblies comprise part of the foot rest actuating mechanism and cause the foot rest platform to move into an extended position by their rearward movement. The opposing slide plates transmit the movement of the arm rest or hand grip assemblies to the foot rest platform through the pivoting parallelogram structure. Accordingly, the opposing slide plates are also considered part of the foot rest actuating mechanism.

The foot rest actuating mechanism includes slide pins which restrict the movement of the arm rest assemblies or hand grip assemblies in relation to the chair attachment means which comprise attachment plates. The arm rest assemblies and hand grip assemblies may move horizontally in relation to the attachment plates only after lifting the assemblies slightly to remove the slide pins from detents disposed within the guide slots of the attachment plates. The horizontal rearward movements of the arm rest assemblies or hand grip assemblies causes a forward movement of the foot rest platform due to the pivoting or levering of the foot rest platform support arms about a pivot bolt.

Once in the desired position, the arm rest assemblies or hand grip assemblies will automatically be held in place as the slide pin extends into a detent. This secures the foot rest platform into the corresponding position where it will remain until repositioned. The foot rest platform can easily be repositioned for comfort and can easily be fully extended or retracted as desired. In addition, the foot rest platform can be vertically adjusted on the foot rest platform support arms. The parallelogram structure employed by the foot rest mechanism preserves the parallel relationship between the floor and the foot rest platform.

FIG. 4 shows an exploded view of a second version of the foot rest mechanism 120. In this version the foot rest actuating mechanism includes a gas spring mechanism 170. The gas spring mechanism 170 includes a gas cylinder 172, a piston 174, and a gas valve actuating lever 176. The gas valve actuating lever 176 operates a gas valve inside the cylinder 172. Upon actuation of the lever 176 the gas within the cylinder moves through the valve. The pressurized gas moving through the valve pushes the piston and causes a portion of the piston to move axially out from the cylinder.

Slide plate 162 includes a cylinder attachment bracket 163 within which the cylinder is secured. Attachment plate 142 includes a piston attachment bracket 144 within which the end of the piston 174 is secured. The attachment plate further includes guide slots 148 and 152 which do not include detents as the gas cylinder acts as a locking mechanism.

In use, the chair user actuates or moves the lever 176 which allows the gas pressure to move the piston 174 axially out from the gas cylinder. The piston, being secured within the piston attachment bracket 144, pushes away from the bracket. This movement causes the cylinder to move rearwardly in relation to the piston attachment bracket 144. The cylinder 172 which is secured within the cylinder attachment bracket 163 moves the slide plate 162 rearwardly as the cylinder moves rearwardly. The slide plate 162 is secured for movement in relation to the attachment plates 142 by slide pins 192 and 194 which are disposed within the guide slots 148 and 152. The rearward movement of the slide plate 162 causes the forward movement of the foot rest platform 122 as the foot rest platform support arm 128 pivots about the pivot bolt 190. The slide plate 162 can be moved rearwardly in relation to the attachment plate 142 to a desired position by the gas spring mechanism. Accordingly, the foot rest platform can be selectively be placed at a variety of positions in relation to the chair.

To retract the foot rest platform 122 the user needs to move the lever 176 while applying a rearward force on the platform 122 which overcomes the gas pressure within the gas spring cylinder.

A single gas spring mechanism 170 has been shown in FIG. 4 which moves both slide plates 162 as the slide plates are attached through connecting member 180. It is understood that a gas spring mechanism could have been employed on each slide plate 162. It is also understood that should gas springs which cause forward and rearward movement be available they would work within this embodiment.

FIG. 5 shows an exploded view of a third version of the foot rest mechanism 220. In this version the foot rest actuating mechanism includes opposing slide plates 262 which each include a cam locking slide pin 294 and a second slide pin 292. The slide pins 292 and 294 are disposed within the guide slots 248 and 252 of attachment plates 242. The cam locking slide pins include a lever which pivots in relation to the pin to allow the cam on the lever to push against the surface of the slide plates 262. As the cam pushes against the slide plate the force effectively locks the slide plate in relation to the attachment plate 242. Pivoting the lever back to the original position disengages the cam from the slide plate which allows the slide pins to move freely within the confines of the guide slots.

Use of this version of the invention necessitates that the user first disengage the locking cam levers and then move the foot rest platform into a desired useable position with their feet. The locking cam levers allow the user to lock the foot rest in this position until he desires to retract or reposition the foot rest which is also performed manually with the feet. The slide plates 262 could have a hand grip or arm rest mechanism later mounted to them if so desired.

FIGS. 6,7 and 8 show a fourth version of the foot rest mechanism 320 of the present invention attached to work chair 300. Work chair 300 includes a seat 312, a chair back 314, a base 316, and a vertically adjustable column 318. The pivoting parallelogram structure has been replaced by a pair of single foot rest platform support arms 328 that are disposed on each end of the foot rest platform 322. The support arms 328 are each pivotally attached to a slide plates 362 at their upper ends. Additionally, the support arms are attached at their lower ends to the foot rest platform 322. As was the case in the first, second and third versions of the invention, the attachment plates of this version of the invention comprise the chair attachment means.

Slide plates 362 include first cam locking slide pins 392 and second slide pins 394 which are disposed within guide slots 348 and 352 of attachment plates 342. Slide pins 392 and 394 slidably attach slide plates 362 to attachment plates 342. The opposing slide plates 362 are connected through a connecting member 380. Accordingly, cam locking slide pins 392 passes through the slide plates, then through slots 352 of the attachment plates, and finally are secured to the connecting mechanism 380. Similarly, slide pins 394 pass through the slide plates, then through support arms 328, through slots 348 of the attachment plates, and finally are secured to the connecting member. Chair attachment plates 342 each include a pivot hole 354 where pivot bolts 390 after passing through slots 340 of support arms 328 are attached.

Using this second version of the foot rest mechanism 320 involves first unlocking the levers of the cam locking slide pins 392. This allows the user to move the foot rest platform 322 into an extended position in front of the chair seat using their feet. As the platform moves forward the support arms pivot about the pivot bolts 390 which cause the slide plates 362 to move rearwardly in relation to the attachment plates 342. The slide pin 394 and cam locking slide pin 392 remain disposed within the guide slots 248 and 352 of the attachment plates. The slide plates 362 and connection member 380 ensure that upper ends of the support arms move in unison, keeping the foot rest mechanism as rigid as possible.

It is understood that the use of two support arms as shown in FIGS. 6–8 would also work within the first, second and third version of the foot rest mechanism as was shown in FIGS. 1–5. Similarly, the cam locking slide pin also could replace the use of detents in the guide slots as was disclosed in the first version should an alternative to the arm rest or hand grip assemblies be desired. This is shown in the third version of the invention shown in FIG. 5. The slide plates of the third and fourth versions could also be provided with attached arm rest or hand grip assemblies to move the slide plates horizontally in relation to the attachment plates. An alternative to the arm rest or hand grip mechanisms would be a gas spring that would be attached to the slide plates for moving the slide plates forward or rearward to actuate the foot rest as was shown in FIG. 4. Such inclusions into the third and fourth versions of the invention would preclude the need to move the foot rest platform with the feet. Accordingly, the teachings of the different versions of the invention are interchangeable.

It is also understood that various modifications and changes in form or detail could readily be made without departing from the spirit of the invention. It is therefore intended that the invention be not limited to the exact form and detail herein shown and described, nor to anything less than the whole of the invention herein disclosed and as hereinafter claimed.

I claim:

1. In combination, a work chair and a foot rest mechanism for a work chair comprising:

a work chair including a base, a column disposed on the base, and a chair seat having a perimeter edge including at least a front and two side edges;

a foot rest comprising:

chair attachment means for attachment to the work chair proximate to the underside of the work chair seat; wherein the chair attachment means is disposed substantially within the perimeter edge of the chair seat;

a foot rest actuating mechanism supported by the chair attachment means for selective forward and rearward movement in relation to the chair attachment means; and a foot contact surface and at least one foot contact surface support arm disposed between the foot contact surface and the chair attachment means;

a first pivot on the chair attachment means; wherein the first pivot is disposed in a substantially horizontal orientation;

wherein the at least one foot contact surface support arm is pivotally attached to the chair attachment means at the first pivot for movement in a substantially vertical plane;

and wherein the at least one foot contact surface support arm moveably suspends the foot contact surface in relation to the chair attachment means;

and, wherein the foot rest actuation mechanism engages the at least one foot contact surface support arm, wherein movement of the foot rest actuating mechanism moves the foot contact surface;

wherein the foot rest contact surface may be centered in relation to the front edge of the chair seat;

and wherein the foot contact surface when centered in relation to the front edge of the chair seat is selectively movable through at least a range of movement from a position where the entirety of each foot contact surface support arm as well as the foot contact surface are substantially disposed beneath the chair seat, within the perimeter edge of the chair seat, wherein the foot contact surface is disposed for direct support of a chair user's feet in an elevated position in relation to a surface on which the chair base is supported; to a position where the foot contact surface is substantially in front of the front of the chair seat; and wherein the foot contact surface is disposed for direct support of a chair user's feet in an elevated position in relation to a surface on which the chair base is supported;

wherein the entirety of the foot contact surface is separated from the chair seat by a spaced apart distance substantially equal to the length of the at least one foot contact surface support arm when the foot contact surface is substantially beneath the front of the chair seat, as well as when the foot contact surface is disposed in front of the front of the chair seat; and wherein the entirety of the foot contact surface is disposed at the spaced apart distance from the chair seat for direct support of a chair user's feet in an elevated position in relation to a surface on which the chair base is supported.

2. The foot rest mechanism of claim 1, additionally comprising a second pivot for engaging the at least one foot contact surface support arm; wherein small movements of the foot rest actuating mechanism correspond to large movements at the foot contact surface; wherein the second pivot engages the at least one foot contact surface support arm beneath the pivotal attachment of the at least one foot contact surface support arm on the chair attachment means, wherein forward movements of the foot rest actuating mechanism cause the at least one foot contact surface support arm to pivot about the second pivot resulting in a rearward movement of the foot contact surface.

3. The foot rest mechanism for a work chair of claim 1, wherein the foot rest actuating mechanism includes at least one slide plate disposed adjacent to the chair attachment means; and wherein each slide plate is disposed for forward and rearward slidable engagement with the chair attachment means.

4. The foot rest mechanism for a work chair of claim 1, wherein the foot rest actuating mechanism additionally comprises at least one arm rest mechanism; wherein small movements of the arm rest mechanism correspond to large movements at the foot contact surface.

5. The foot rest mechanism for a work chair of claim 1, wherein the foot rest actuating mechanism additional comprises at least one hand grip mechanism; wherein small movements of the hand grip mechanism correspond to large movements at the foot contact surface.

6. The foot rest mechanism for a work chair of claim 1, wherein the chair attachment means comprises first and second attachment plates, wherein each attachment plate includes a guide slot and wherein the guide slots further include detents;

and wherein the foot rest actuating mechanism includes a slide plate disposed adjacent to each of the attachment plates of the chair attachment means; and wherein the slide plates include a slide pin for forward and rearward slidable engagement within the chair attachment means guide slots and for retention within the guide slot detents wherein the slide pin is temporarily prevented from forward or rearward movement within the guide slot.

7. The foot rest mechanism of claim 1, additionally comprising means to lock the foot rest actuating mechanism in a fixed forward or rearward position in relation to the chair attachment means.

8. The foot rest mechanism for a work chair of claim 7, wherein the means to lock the foot rest actuating mechanism in a fixed forward or rearward position in relation to the chair attachment means comprises a locking cam lever.

9. The foot rest mechanism for a work chair of claim 1, additionally comprising means to adjust the vertical position of the foot contact surface on the foot contact surface support arms.

10. The foot rest mechanism for a work chair of claim 1, wherein the foot rest actuating mechanism additionally comprises a gas spring mechanism, wherein small movements of the gas spring mechanism correspond to large movements of the foot contact surface.

11. In combination, a work chair and a foot rest mechanism for a work chair comprising:

a work chair including a base, a column disposed on the base, and a chair seat;

a foot rest comprising:

chair attachment means for attachment to the underside of the work chair seat;

a foot rest actuating mechanism supported by the chair attachment means for movement in relation to the chair attachment means; and wherein the foot rest actuating mechanism includes a hand grip mechanism for selective forward and rearward, non-rotational movement in relation to the chair attachment means;

a foot contact surface and at least one foot contact surface support arm disposed between the foot contact surface and the chair attachment means; wherein the at least one foot contact surface support arm moveably suspends the foot contact surface in relation to the chair seat;

wherein the at least one foot contact surface support arm is pivotally attached to the chair attachment means;

and, wherein the foot rest actuation mechanism engages the at least one foot contact surface support arm, wherein movement of the foot rest actuation mechanism actuates movement of the foot contact surface;

and wherein the foot contact surface is disposed for direct support of a chair user's feet in an elevated position in relation to a surface on which the chair base is supported; and wherein selective movement of the hand grip mechanism actuates movement of the foot contact surface.

12. The foot rest mechanism of claim 11, additionally comprising a second pivot for engaging the at least one foot contact surface support arm; wherein small movements of the foot rest actuating mechanism correspond to large movements at the foot contact surface.

13. The foot rest mechanism of claim 12, wherein the second pivot engages the at least one foot contact surface support arm beneath the pivotal attachment of the at least one foot contact surface support arm on the chair attachment means, wherein forward movements of the foot rest actuating mechanism cause the at least one foot contact surface support arm to pivot about the second pivot resulting in a rearward movement of the foot contact surface.

14. The foot rest mechanism for a work chair of claim 11, wherein the foot rest actuating mechanism includes at least one slide plate disposed adjacent to the chair attachment means; and wherein each slide plate is disposed for forward and rearward slidable engagement with the chair attachment means.

15. The foot rest mechanism for a work chair of claim 11, additionally comprising means to adjust the vertical position of the foot contact surface on the at least one foot contact surface support arm.

16. The foot rest mechanism for a work chair of claim 11, wherein the hand grip mechanism actuates a gas spring.

17. In combination, a work chair and a foot rest mechanism for a work chair comprising:

a work chair including a base, a column disposed on the base, and a chair seat having a perimeter edge including at least a front and two side edges;

a foot rest comprising:

chair attachment means for attachment to the work chair proximate to the underside of the work chair seat; wherein the chair attachment means is disposed substantially within the perimeter edge of the chair seat;

a foot rest actuating mechanism supported by the chair attachment means for movement in relation to the chair attachment means; and wherein the foot rest actuating mechanism includes a hand grip mechanism for selective forward and rearward movement in relation to the chair attachment means;

a foot contact surface and at least one foot contact surface support arm disposed between the foot contact surface and the chair attachment means; wherein the at least one foot contact surface support arm moveably suspends the foot contact surface in relation to the chair seat;

a first pivot on the chair attachment means; wherein the first pivot is disposed in a substantially horizontal orientation;

wherein the at least one foot contact surface support arm is pivotally attached to the chair attachment means at the first pivot for movement in a substantially vertical plane;

and, wherein the foot rest actuation mechanism engages the at least one foot contact surface support arm, wherein movement of the hand grip mechanism moves the foot contact surface;

wherein the foot rest contact surface may be centered in relation to the front edge of the chair seat;

and wherein the foot contact surface when centered in relation to the front edge of the chair seat is selectively movable through at least a range of movement from a position where the entirety of each foot contact surface support arm as well as the foot contact surface are substantially disposed beneath the chair seat, within the perimeter edge of the chair seat, to a position where the foot contact surface is substantially in front of the front of the chair seat; and wherein the foot contact surface is disposed for direct support of a chair user's feet in an elevated position in relation to a surface on which the chair base is supported.

18. The foot rest mechanism of claim 17, additionally comprising a second pivot for engaging the at least one foot contact surface support arm; wherein small movements of the foot rest actuating mechanism correspond to large movements at the foot contact surface.

19. The foot rest mechanism of claim 18, wherein the second pivot engages the at least one foot contact surface support arm beneath the pivotal attachment of the at least one foot contact surface support arm on the chair attachment means, wherein forward movements of the foot rest actuating mechanism cause the at least one foot contact surface support arm to pivot about the second pivot resulting in a rearward movement of the foot contact surface.

20. The foot rest mechanism for a work chair of claim 17, wherein the foot rest actuating mechanism includes at least one slide plate disposed adjacent to the chair attachment means; and wherein each slide plate is disposed for forward and rearward slidable engagement with the chair attachment means.

21. The foot rest mechanism for a work chair of claim 17, additionally comprising means to adjust the vertical position of the foot contact surface on the at least one foot contact surface support arm.

22. The foot rest mechanism for a work chair of claim 17, wherein the hand grip mechnism actutes gas spring.

23. In combination, a work chair and a foot rest mechanism for a work chair comprising:

a work chair including a base, a column disposed on the base, and a chair seat;

a foot rest comprising:

chair attachment means for attachment to the work chair;

a foot rest actuating mechanism supported by the chair attachment means for movement in relation to the chair attachment means; and wherein the foot rest actuating mechanism includes an arm rest mechanism for selective movement in relation to the chair attachment means; wherein the arm rest mechanism extends to a vertical position above the chair seat;

a foot contact surface and at least one foot contact surface support arm disposed between the foot contact surface and the chair attachment means; wherein the at least one foot contact surface support arm moveably suspends the foot contact surface;

wherein the at least one foot contact surface support arm is pivotally attached to the chair attachment means;

and, wherein the foot rest actuation mechanism engages the at least one foot contact surface support arm wherein movement of the arm rest mechanism actuates movement of the foot contact surface;

and wherein the foot contact surface is disposed for direct support of a chair user's feet in an elevated position in relation to a surface on which the chair base is supported.

24. The foot rest mechanism of claim 23, additionally comprising a second pivot for engaging the at least one foot contact surface support arm; wherein small movements of the foot rest actuating mechanism correspond to large movements at the foot contact surface.

25. The foot rest mechanism of claim 24, wherein the second pivot engages the at least one foot contact surface support arm beneath the pivotal attachment of the at least one foot contact surface support arm on the chair attachment means, wherein forward movements of the foot rest actuating mechanism cause the at least one foot contact surface support arm to pivot about the second pivot resulting in a rearward movement of the foot contact surface.

26. The foot rest mechanism for a work chair of claim 23, wherein the foot rest actuating mechanism includes at least one slide plate disposed adjacent to the chair attachment means; and wherein each slide plate is disposed for forward and rearward slidable engagement with the chair attachment means.

27. The foot rest mechanism for a work chair of claim 23, additionally comprising means to adjust the vertical position of the foot contact surface on the at least one foot contact surface support arm.

28. In combination, a work chair and a foot rest mechanism for a work chair comprising:

a work chair including a base, a column disposed on the base, and a chair seat;

a foot rest comprising:

chair attachment means for attachment to the work chair;

a foot rest actuation mechanism; and a foot contact surface and at least two foot contact surface support arms disposed between the foot contact surface and the chair attachment means; wherein the at least two foot contact surface support arms moveably suspend the foot contact surface;

wherein the at least two foot contact surface support arms are pivotally attached to the chair attachment means and pivot in substantially vertical parallel planes;

and, wherein the foot rest actuation mechanism engages at least one of the at least two foot contact surface support arms;

and wherein the foot contact surface is disposed for direct support of a chair user's feet in an elevated position in relation to a surface on which the chair base is supported; and wherein the at least two foot contact surface support arms are disposed within a pivoting parallelogram structure which supports the foot contact surface for forward and rearward movement in relation to the work chair seat;

and wherein the movement of the foot contact surface is defined by curvilinear translation.

29. The foot rest mechanism of claim 28, additionally comprising a second pivot for engaging at least one foot contact surface support arm; wherein movement of the foot rest actuating mechanism forces the at least two foot contact surface support arms to pivot about the second pivot; wherein small movements of the foot rest actuating mechanism correspond to large movements at the foot contact surface.

30. The foot rest mechanism of claim 29, wherein the second pivot engages at least one foot contact surface support arm beneath the pivotal attachment of the foot contact surface support arm on the chair attachment means, wherein forward movements of the foot rest actuating mechanism cause the at least two foot contact surface support arms to pivot about the second pivot resulting in a rearward movement of the foot contact surface.

31. The foot rest mechanism for a work chair of claim 28, wherein the foot rest actuating mechanism includes at least one slide plate disposed adjacent to the chair attachment means; and wherein each slide plate is disposed for forward and rearward slidable engagement with the chair attachment means.

32. The foot rest mechanism of claim 28, comprising four foot contact surface support arms wherein two sets of two foot contact surface support arms are attached to the foot contact surface; and wherein each set of two foot contact surface support arms are disposed within a pivoting parallelogram structure which supports the foot contact surface for forward and rearward movement in relation to the work chair seat.

33. The foot rest mechanism for a work chair of claim 28, additionally comprising means to adjust the vertical position of the foot contact surface on the foot contact surface support arms.

34. The foot rest mechanism for a work chair of claim 28, wherein the foot rest actuating mechanism additionally comprises an arm rest mechanism.

35. The foot rest mechanism for work chair of claim 28, wherein the foot rest actuating mechanism additionally comprises a hand grip mechanism.

36. The foot rest mechanism for a work chair of claim 28, wherein the foot rest actuating mechanism additionally comprises a gas spring mechanism.

* * * * *